US008464470B2

(12) United States Patent
Katagata et al.

(10) Patent No.: US 8,464,470 B2
(45) Date of Patent: Jun. 18, 2013

(54) RAILWAY PLATFORM DOOR DEVICE

(75) Inventors: Satoshi Katagata, Tokyo (JP); Kota Iwasaki, Tokyo (JP); Masanori Furukawa, Tokyo (JP); Takeshi Fuse, Tokyo (JP); Hiromasa Tsutsumi, Kobe (JP)

(73) Assignee: Nabtesco Corporation (JP)

( * ) Notice: Subject to any disclaimer, the term of this patent is extended or adjusted under 35 U.S.C. 154(b) by 0 days.

(21) Appl. No.: 13/201,493

(22) PCT Filed: Feb. 19, 2010

(86) PCT No.: PCT/JP2010/001092

§ 371 (c)(1),
(2), (4) Date: Sep. 13, 2011

(87) PCT Pub. No.: WO2010/095454

PCT Pub. Date: Aug. 26, 2010

(65) Prior Publication Data

US 2012/0031006 A1 Feb. 9, 2012

(30) Foreign Application Priority Data

Feb. 19, 2009 (JP) ..... 2009-036156

(51) Int. Cl.
*E05F 15/00* (2006.01)

(52) U.S. Cl.
USPC ..... 49/360

(58) Field of Classification Search
USPC ..... 49/404, 360, 49, 358, 323; 105/341, 105/425
See application file for complete search history.

(56) References Cited

U.S. PATENT DOCUMENTS

| | | | | | |
|---|---|---|---|---|---|
| 1,631,416 | A | * | 6/1927 | Howard | 49/358 |
| 2,278,706 | A | * | 4/1942 | Laufersweiler et al. | 49/365 |
| 4,916,860 | A | * | 4/1990 | Richmond et al. | 49/28 |
| 5,076,012 | A | * | 12/1991 | Richmond et al. | 49/28 |
| 5,170,585 | A | * | 12/1992 | Wen | 49/358 |
| 5,373,664 | A | * | 12/1994 | Butler | 49/358 |
| 6,092,338 | A | * | 7/2000 | Crowner et al. | 49/360 |
| 6,094,863 | A | * | 8/2000 | LaCook, Jr. | 49/49 |
| 8,176,684 | B2 | * | 5/2012 | Marchetto | 49/506 |
| 2009/0188166 | A1 | * | 7/2009 | Taheri et al. | 49/31 |
| 2009/0211160 | A1 | * | 8/2009 | Tehranchi | 49/360 |

(Continued)

FOREIGN PATENT DOCUMENTS

| | | | | |
|---|---|---|---|---|
| DE | 3619516 | A1 | * | 12/1987 |
| EP | 94628 | A2 | * | 11/1983 |

(Continued)

*Primary Examiner* — Jerry Redman
(74) *Attorney, Agent, or Firm* — Gerald E. Hespos; Michael J. Porco; Matthew T. Hespos

(57) ABSTRACT

Provided is a platform door device which makes it possible to reduce the length of time for a replacement operation when a panel-shaped portion of a door is damaged. The platform door device comprises a door, and a driving mechanism for moving the door forwardly and backwardly to close and open a gate on a platform. The driving mechanism includes a motor, a rotation body adapted to be rotated by the motor, and a driven body adapted to be driven according to the rotation of the rotation body so as to move the door, and the door has a panel-shaped main body, and a base segment detachably joined to the main body and attached to the driven body.

8 Claims, 7 Drawing Sheets

U.S. PATENT DOCUMENTS

| | | | | |
|---|---|---|---|---|
| 2009/0241427 | A1* | 10/2009 | Yu | 49/404 |
| 2010/0024307 | A1* | 2/2010 | Dale et al. | 49/360 |
| 2010/0319257 | A1* | 12/2010 | Taheri et al. | 49/31 |
| 2012/0066976 | A1* | 3/2012 | Murray et al. | 49/358 |
| 2012/0260576 | A1* | 10/2012 | Cavalcante | 49/358 |

FOREIGN PATENT DOCUMENTS

| | | | |
|---|---|---|---|
| JP | 02300488 | A * | 12/1990 |
| JP | 04140392 | A * | 5/1992 |
| JP | 6239224 | | 8/1994 |
| JP | 9226568 | | 9/1997 |
| JP | 2000-54767 | | 2/2000 |
| JP | 2002274170 | | 9/2002 |
| JP | 2006056317 | | 3/2006 |
| JP | 2006-240529 | | 9/2006 |
| JP | 200862795 | | 3/2008 |
| JP | 2008050799 | | 3/2008 |
| JP | 2008062795 | | 3/2008 |

* cited by examiner

RAILWAY PLATFORM DOOR DEVICE

BACKGROUND OF THE INVENTION

1. Field of the Invention

The present invention relates to a platform door device.

2. Description of the Related Art

Heretofore, there has been known a platform door device installed along an edge of a platform on the side of a rail track in order to ensure safety of passengers. One example of such a platform door device is disclosed in JP 2006-240529A.

A platform door device disclosed in JP 2006-240529A comprises a door, a guiding mechanism, and a driving mechanism.

The door has a panel-shaped portion composed of a frame assembly and a glass plate set in the frame assembly. The door is adapted to be guided by the guiding mechanism in such a manner as to be movable forwardly and backwardly in a horizontal direction along an edge of a platform.

The guiding mechanism includes a linear rail attached to the frame assembly of the door so as to extend in a direction of the movement of the door, and a slide block fixed to an inside of a guide box installed on the platform and slidably provided to the linear rail.

The driving mechanism is provided inside the guide box and beneath the door. The driving mechanism includes a motor, a driving pulley, a pair of idler pulleys, and a toothed belt. The driving pulley has teeth, and is adapted to be rotated according to driving of the motor. The pair of idler pulleys are disposed to interpose the driving pulley therebetween. The toothed belt is wound over the pair of idler pulleys and meshed with the teeth of the driving pulley at a position between the idler pulleys. One end of the toothed belt is attached to a lower region of one end of the frame assembly in the movement direction of the door, through a bracket. The other end of the toothed belt is attached to a lower region of the other end of the frame assembly in the movement direction of the door, through a bracket. The toothed belt is held between the both ends of the frame assembly of the door, while being tightened with a given tension.

In the driving mechanism, the driving pulley is rotated according to driving of the motor, and thereby the toothed belt is moved. According to the movement of the toothed belt, the door is pulled and thereby moved forwardly or backwardly. Then, according to the forward and backward movements of the door, a gate on the platform is opened and closed.

In the above platform door device, in the event of damage to the panel-shaped portion of the door, the damaged door will be replaced with a new one. In this replacement operation, it is necessary to detach the toothed belt from the frame assembly. Then, after attaching a new door to the platform door device, and attaching the toothed belt between both ends of a lower portion of a frame assembly of the new door, it is necessary to perform adjustment of the driving mechanism, such as adjustment of belt tension. This causes a problem of an increase in time required for the replacement operation.

SUMMARY OF THE INVENTION

It is an object of the present invention to provide a platform door device capable of reducing a time required for a replacement operation in the event of damage to a panel-shaped portion of a door.

A platform door device according to one aspect of the present invention comprises a door, and a driving mechanism for moving the door forwardly and backwardly to close and open a gate on a platform, wherein: the driving mechanism includes a motor, a rotation body adapted to be rotated by the motor, and a driven body adapted to be driven according to the rotation of the rotation body so as to move the door; and the door has a panel-shaped main body, and a base segment detachably joined to the main body and attached to the driven body.

DETAILED DESCRIPTION OF THE PREFERRED EMBODIMENTS

The embodiments of the present invention will be described below with reference to the drawings.

Figure 1:
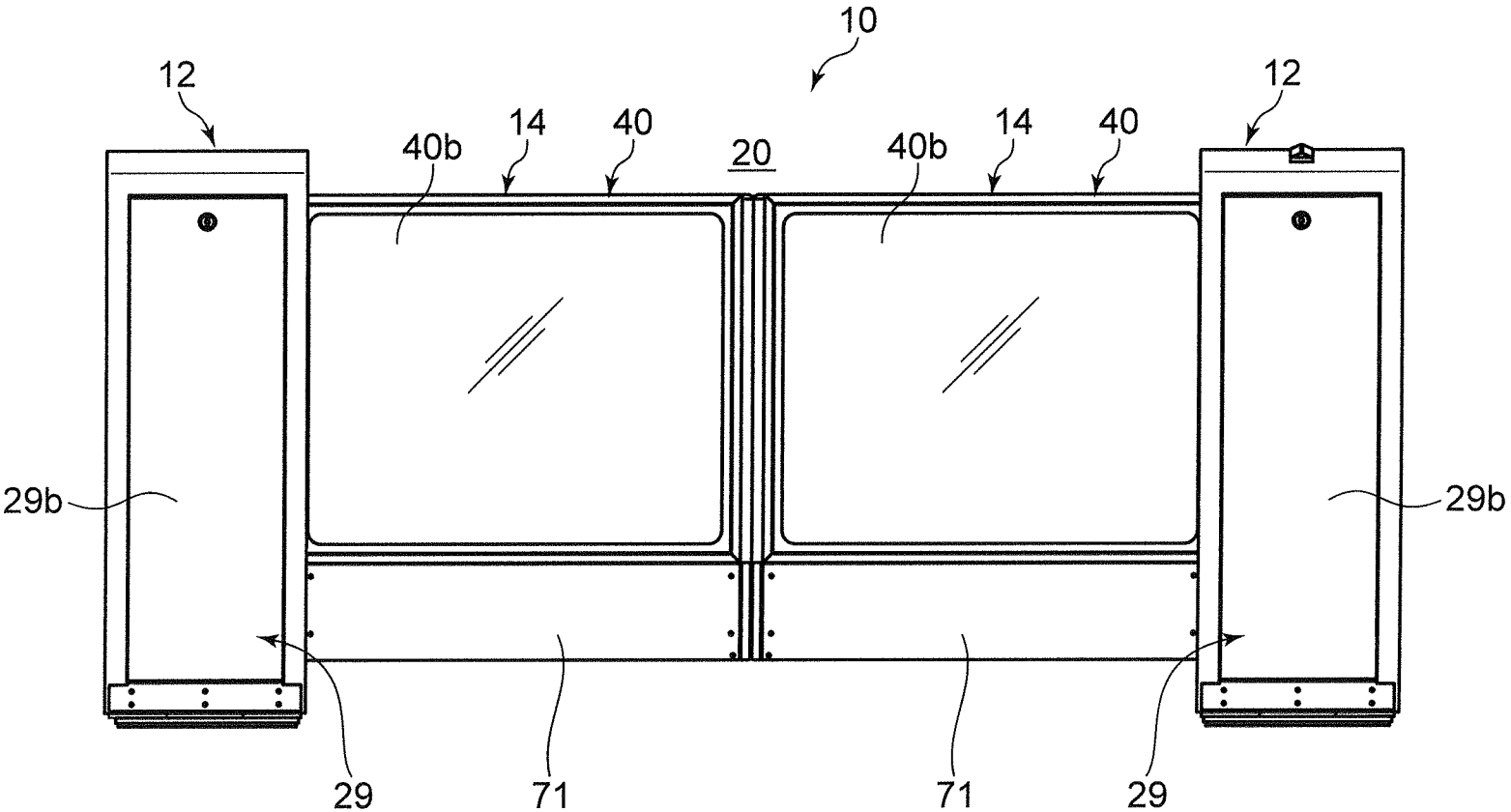
FIG. 1 is a front view of a platform door device according to an embodiment of the present invention.

FIG. 1 is a front view of a platform door device 10 according to one embodiment of the present invention, when viewed in a direction from the side of a platform P to a rail track. As illustrated in FIG. 1, the platform door device 10 comprises a pair of guide boxes 12, 12, and a pair of doors 14, 14. The pair of guide boxes 12, 12 are installed on the platform P along an edge of the platform P on the side of the track, while leaving a given distance therebetween. The guide box 12 is included in a concept of "guide body" in the present invention. A support box (illustration is omitted) and a fixed partition wall (illustration is omitted) may be installed adjacent to the guide box 12. Each of the doors 14 is a sliding type, and supported by a corresponding one of the guide boxes 12 in a movable manner.

In cases where a large number of the platform door devices 10 are arranged along the edge of the platform P while interposing the support box and the fixed partition wall therein, a space on the platform P will be divided into a track-side space, and a space inward of the track-side space (platform inner-side space). When the two doors 14 are in their closed positions as illustrated in FIG. 1, a gate 20 between the pair of guide boxes 12 is closed. On the other hand, when each of the doors 14 is driven by an aftermentioned driving mechanism 55 and thereby moved backwardly to its opened position, the gate 20 is opened.

Each of the guide boxes 12 is designed to be installable on the platform P, and adapted to allow the door 14 to penetrate therethrough in a direction along the track, i.e., a rightward-leftward direction in FIG. 1. Although the platform door device 10 is formed as a so-called double sliding-type movable fence, it is not limited thereto. For example, the platform door device may be formed as a single sliding-type movable fence which comprises a single guide box 12, and a single door 14 supported by the guide box 12.

With reference to FIGS. 2 to 7, respective specific structures of the guide box 12 and the door 14 will be described below. The guide box 12 and the door 14 on the left side in FIG. 1 are structurally symmetrical to the guide box 12 and the door 14 on the right side in FIG. 1. Thus, only the structures of the guide box 12 and the door 14 on the right side in FIG. 1 will be described here.

Figure 2:
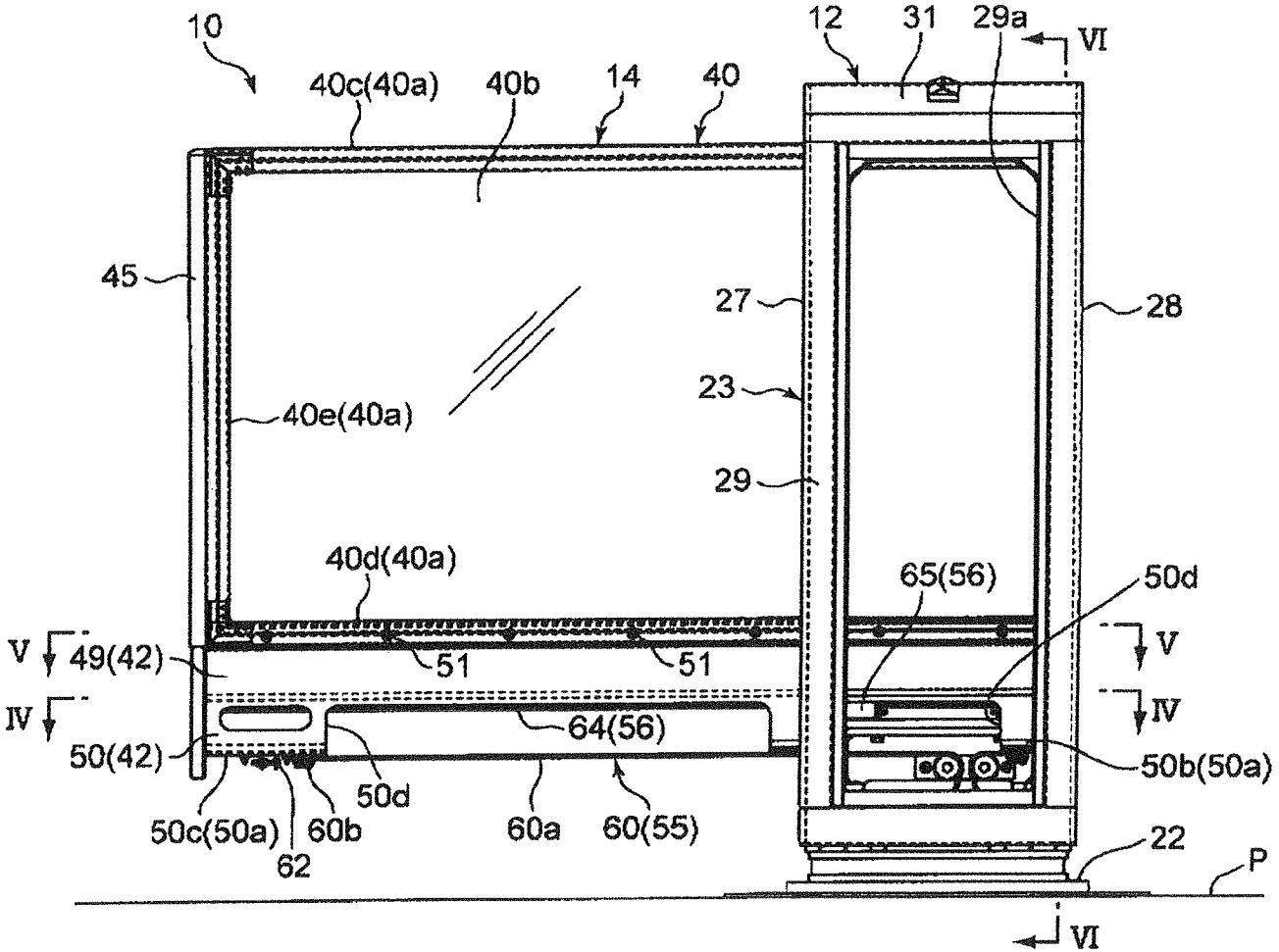
FIG. 2 is a diagram illustrating a guide box, a door and a support box, on a right side in FIG. 1.
Figure 3:
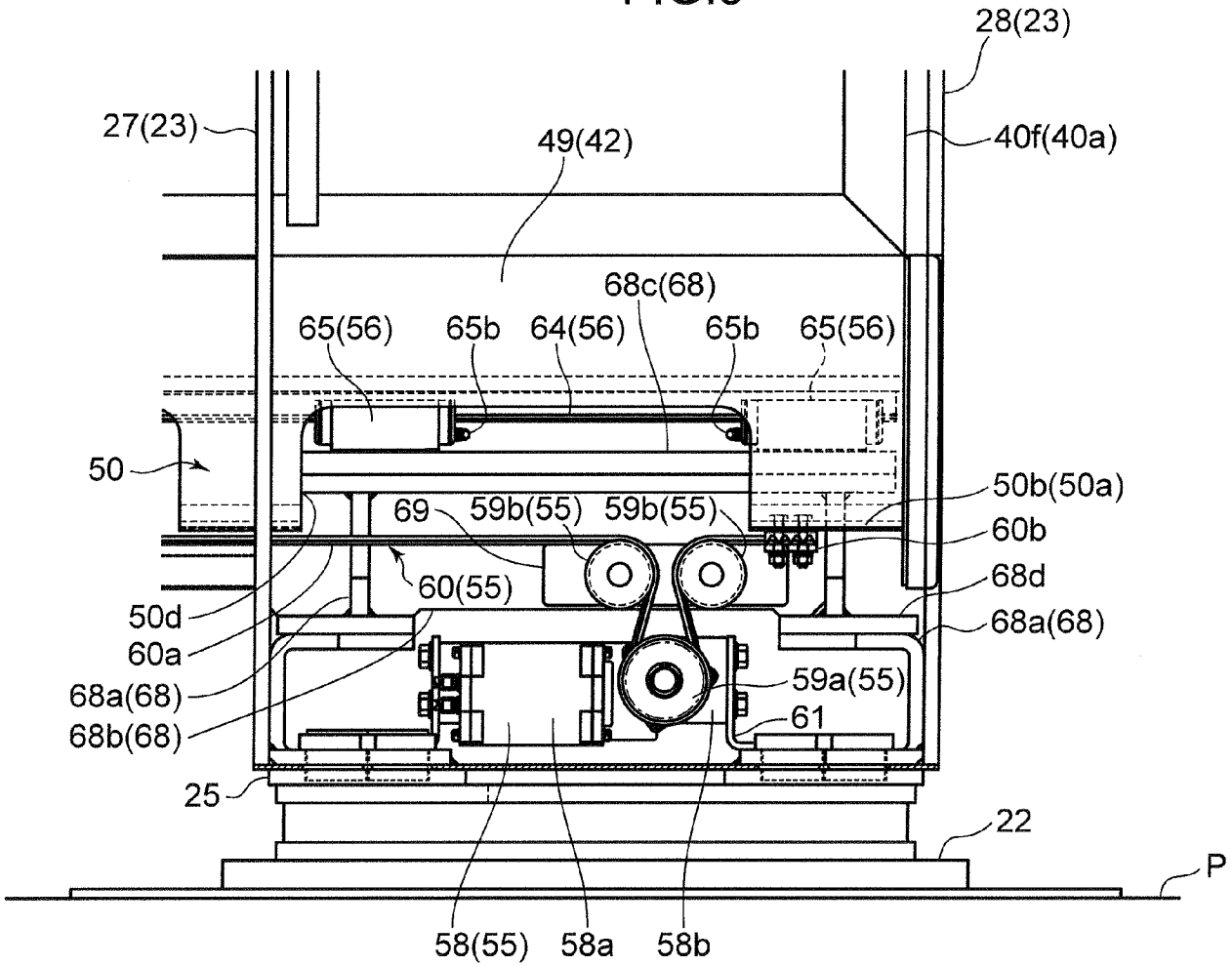
FIG. 3 is a fragmentary enlarged view of the structure in FIG. 2, wherein a panel member located on an inner side of a platform is removed.
Figure 4:
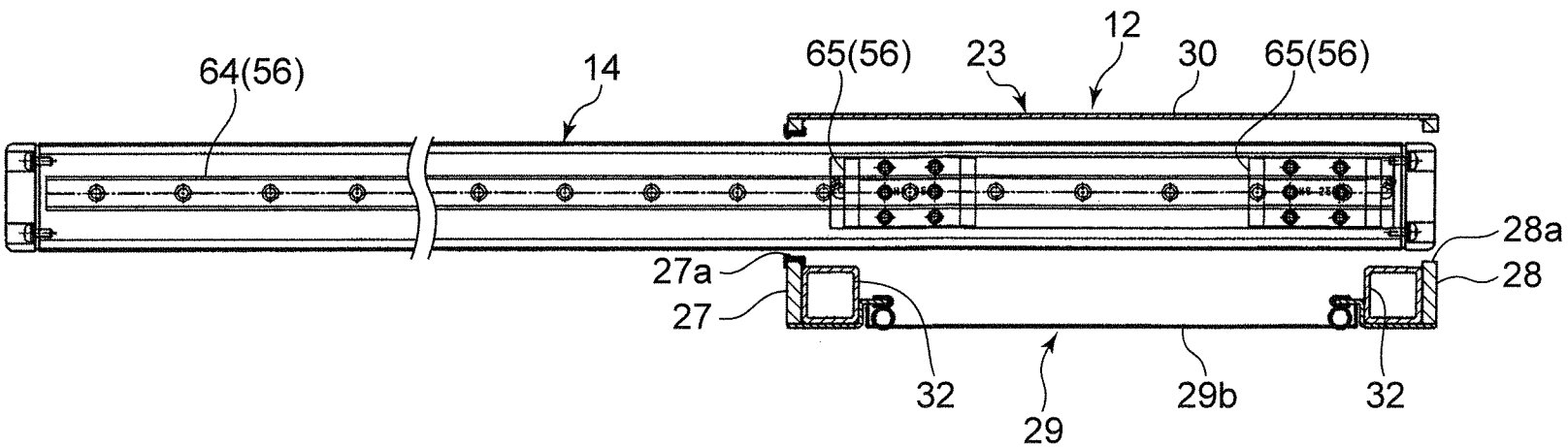
FIG. 4 is a sectional view taken along the line IV-IV in FIG. 2.
Figure 5:
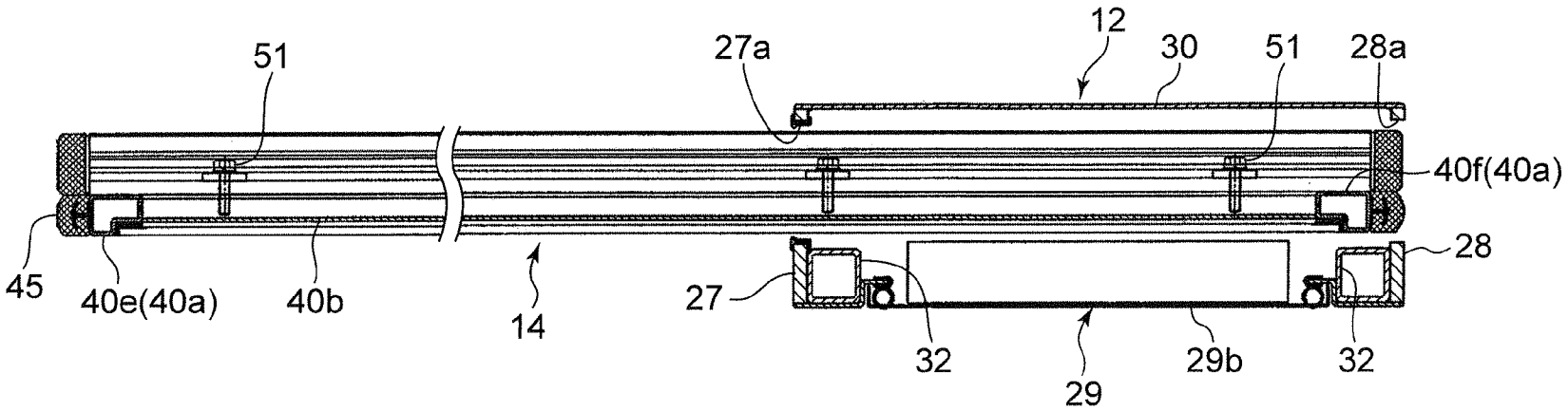
FIG. 5 is a sectional view taken along the line V-V in FIG. 2.

As illustrated in FIGS. 2 and 3, the guide box 12 comprises a base 22 fixed to the platform P, and a casing 23 fixed to the base 22. The casing 23 has a bottom portion 25, a pair of end walls 27, 28, a pair of lateral walls 29, 30, a top portion 31, and a support pillar 32. The bottom portion 25 is fixed onto the base 22. The pair of end walls 27, 28 are disposed in spaced-apart relation to each other in a widthwise direction of the casing 23, i.e., in a door opening/closing direction. The pair of lateral walls 29, 30 are disposed in spaced-apart relation to each other in a thicknesswise direction of the casing 23, i.e., in a direction perpendicular to the door opening/closing direction. The top portion 31 connects between respective upper ends of the end walls 27, 28 and between respective upper ends of the lateral walls 29, 30. Thus, the guide box 12 is formed in a hollow structure having a rectangular cross-section in top plan view, as illustrated in FIGS. 4 and 5. One of the pair of end walls located on the side of the gate 20 will hereinafter be referred to as "leading-side end wall 27", and the other end wall located on the opposite side will hereinafter be referred to as "trailing-side end wall 28". In the pair of lateral walls 29, 30, the lateral wall 30 located on the side of the track is provided with two auxiliary sensors 35 for detecting a passer passing through the gate 20, the auxiliary sensors 35 are arranged upper portion and lower portion of the lateral wall 30.

As illustrated in FIG. 2, in the pair of lateral walls 29, 30, the lateral wall 29 located on the platform inner side is formed with an opening 29*a*. This opening 29*a* is used during maintenance. A cover 29*b* to open and close the opening 29*a* is detachably attached to the lateral wall 29 (see FIG. 1).

As illustrated in FIGS. 4 and 5, the leading-side end wall 27 is formed with an opening 27*a*, and the trailing-side end wall 28 is formed with an opening 28*a*. Each of the two openings 27*a*, 28*a* is designed to allow the door 14 to path therethrough. When the door 14 is in the closed position, a trailing end of the door 14 is located adjacent to the trailing-side end wall 28, as illustrated in FIGS. 4 and 5. On the other hand, when the door 14 is in the opened position, a leading end of the door 14 is located adjacent to the leading-side end wall 27.

As illustrated, for example, in FIG. 2, the door 14 comprises a panel-shaped main body 40, and a base segment 42 detachably joined to the main body 40.

The main body 40 includes a frame assembly 40*a* and a glass plate 40*b*. The frame assembly 40*a* is formed by assembling a plurality of hollow frame members together in a frame shape. The frame assembly 40*a* has an upper frame 40*c*, lower frame 40*d*, a leading frame 40*e* and a trailing frame 40*f*. The upper frame 40*c* forms an upper end of the frame assembly 40*a*, and the lower frame 40*d* forms a lower end of the frame assembly 40*a*. Each of the upper frame 40*c* and the lower frame 40*d* extends horizontally along the door opening/closing direction. The leading frame 40*e* forms a leading-side end of the frame assembly 40*a*, and the trailing frame 40*f* forms a trailing-side end of the frame assembly 40*a*. Each of the leading frame 40*e* and the trailing frame 40*f* extends in an upward-downward direction. The glass plate 40*b* serving as a panel member is fixedly attached to the frame assembly 40*a* so as to close a space formed by the frames 40*c*, 40*d*, 40*e*, 40*f*. A panel member to be fixedly attached to the frame assembly 40*a* is not limited to the glass plate 40*b*, but may be any other suitable type of panel member, such as a transparent plate made of resin or the like, or a metal panel.

The base segment 42 has a width dimension equal to that of the frame assembly 40*a*, in the door opening/closing direction, i.e., in a widthwise direction of the door 14. Further, the base segment 42 has a leading-side end surface flush with a leading-side end surface of the frame assembly 40*a*, and a leading rubber 45 (see FIG. 2) is attached to cover across the two end surfaces.

Figure 7:
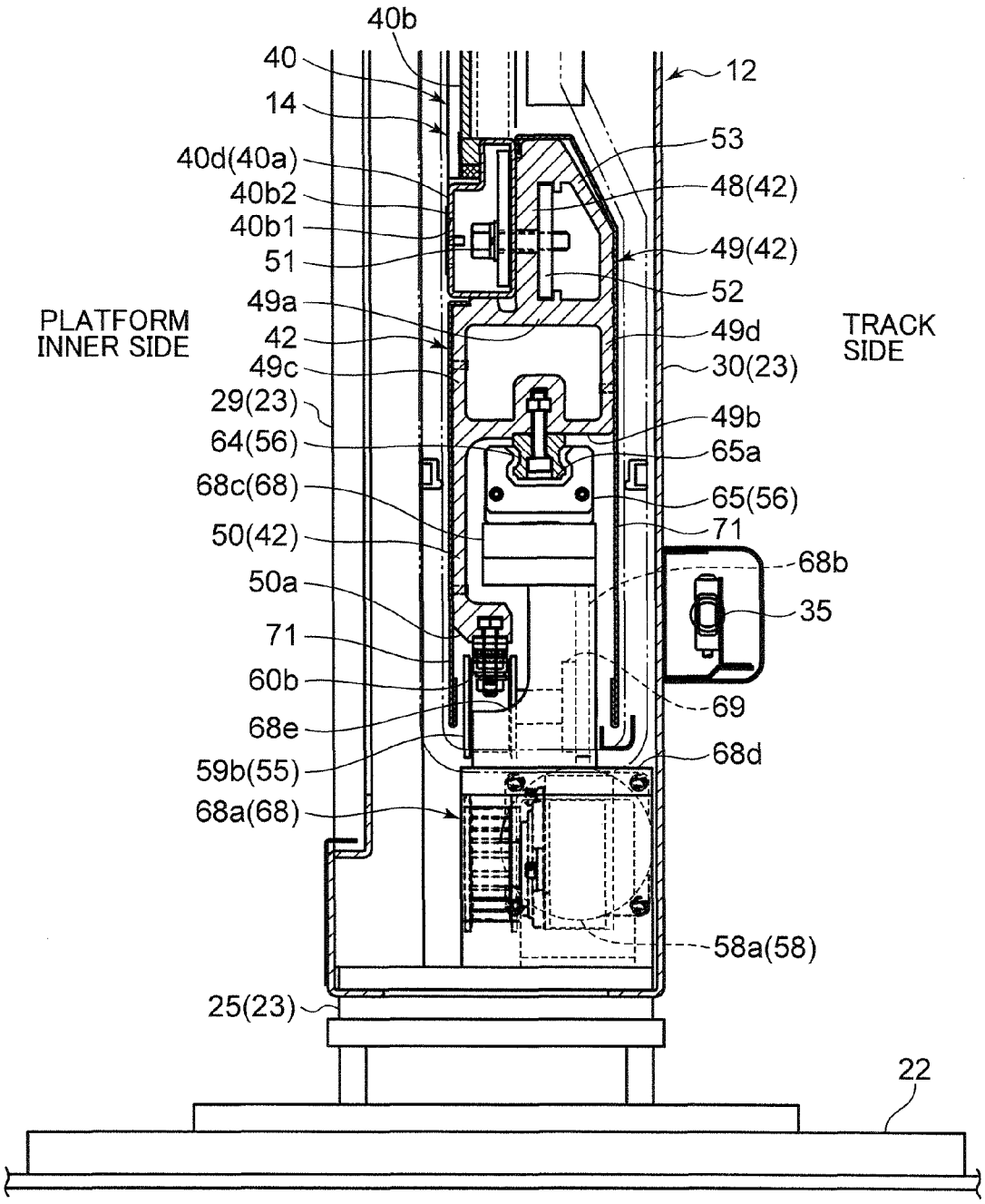
FIG. 7 is a fragmentary enlarged view of the structure in FIG. 6.

The base segment 42 is detachably joined to the lower frame 40*d* of the frame assembly 40*a* of the main body 40. An aftermentioned belt member 60 and an aftermentioned linear rail 64 are attached to the base segment 42. As illustrated in FIG. 7, the base segment 42 has a joining portion 48, a mounting portion 49, and an extension portion 50. The joining portion 48, the mounting portion 49 and the extension portion 50 are integrally formed. The joining portion 48 is formed to have a given width in the upward-downward direction, and located on a lateral side of the lower frame 40*d*. The width of the joining portion 48 in the upward-downward direction is set to a value approximately equal to a width of the lower frame 40*d* in the upward-downward direction. A lateral surface of the joining portion 48 is joined to a lateral surface of the lower frame 40*d*. The base segment 42 is provided with a bridging portion 53. The bridging portion 53 is bridged between an upper end of the joining portion 48 and a track-side end of an aftermentioned upper section 49*a* of the mounting portion 49. The joining portion 48, the upper section 49*a* of the mounting portion 49, and the bridging portion 53 are joined to each other to form a closed loop cross-section.

The joining portion 48 has a plurality of insertion holes formed in the door opening/closing direction at given intervals. Each of the insertion holes penetrates through the joining portion 48 in a horizontal direction. A nut plate 52 formed with a plurality of threaded holes is provided on a track-side of the joining portion 48 so as to extend along the joining portion 48. The nut plate 52 is non-rotatably held by the bridging portion 53. On the other hand, a portion of the lower frame 40*d* located on the side of the track is formed with insertion holes at positions corresponding to respective ones of the insertion holes of the joining portion 48. A bolt 51 inserted from the platform inner side into corresponding ones of the insertion holes of the lower frame 40*d* and the joining portion 48 is screwed in the nut plate 52, so that the joining portion 48 and the lower frame 40*d* are fixed together. In other words, the joining portion 48 is joined to the frame assembly 40*a* from a lateral direction. A platform inner-side portion of the lower frame 40*d* has a through-hole 40*b*1 formed to allow the bolt 51 to be inserted therethrough, and a cover 40*b*2 detachably attached thereto to close the through-hole 40*b*1.

The frame assembly 40*a* can be separated from the base segment 42 by unfastening the bolts 51 from the nut plate 51. Each of the bolts 51 is laterally inserted into the corresponding insertion holes of the lower frame 40*d* and the joining portion 48 through the through-hole 40*b*1, so that fastening and unfastening operations for the bolts 52 and the nut plate 52 can be performed from the platform inner side.

The mounting portion 49 is a region having rigidity capable of supporting the aftermentioned linear rail 64. The mounting portion 49 is formed in a hollow shape extending in a direction of the movement of the door 14. The mounting portion 49 is formed in a tubular shape having a generally rectangular cross-section. The mounting portion 49 has an upper section 49*a*, a lower section 49*b*, a first lateral section 49*c*, and a second lateral section 49*d*. The upper section 49*a*, the lower section 49*b*, the first lateral section 49*c* and the second lateral section 49*d* are integrally formed. The upper section 49*a* is a plate-shaped region which extends in a horizontal direction and has a given width in a thicknesswise direction of the door 14. The joining portion 48 is provided to extend upwardly from a widthwise intermediate region of the upper section 49*a*.

The first lateral section 49*c* extends downwardly from one of widthwise opposite ends of the upper section 49*a*, and the second lateral section 49*d* extends downwardly from the other end of the upper section 49*a*. Each of the first lateral section 49*c* and the second lateral section 49*d* has a given height dimension. The first lateral section 49*c* makes up a platform inner-side lateral wall of the mounting portion 49, and the second lateral section 49*d* makes up a track-side lateral wall of the mounting portion 49. The lower section 49*b* connects a lower end of the first lateral section 49*c* and a lower end of the second lateral section 49*d* together, and extends between these lower ends in a horizontal direction.

The extension portion 50 is provided to extend downwardly directly from the first lateral section 49*c* of the mounting portion 49. The extension portion 50 has a lower end 50*a* slightly bulging toward the track within a thickness range of the frame assembly 40*a*. A first belt joining portion 50*b* is provided on a trailing-side end of the lower end 50*a*, and a second belt joining portion 50*c* is provided on a leading-side end of the lower end 50*a*. The first belt joining portion 50*b* is a portion to be joined to one end of the aftermentioned belt member 60, and the second belt joining portion 50*c* is a portion to be joined to the other end of the aftermentioned belt member 60.

The platform door device 10 comprises a driving mechanism 55 for moving the door 14 forwardly and backwardly to close and open the gate 20 on the platform P, and a guiding mechanism 56 for guiding the door 14 which is being moved forwardly or backwardly. The driving mechanism 55 and the guiding mechanism 56 are provided for each of the right and left doors 14.

As illustrated in FIGS. 2 and 3, the driving mechanism 55 includes a motor 58, a driving pulley 59*a*, a pair of idler pulleys 59*b*, 59*b*, and a belt member 60. The driving pulley 59*a* is included in a concept of "rotation body" of the present invention, and the idler pulley 59*b* is included in a concept of "pulley" of the present invention. Further, the belt member 60 is included in a concept of "driven body" of the present invention. The driving pulley 59*a* is disposed just below the frame assembly 40*a*, and formed to fall approximately within the thickness range of the frame assembly 40*a*.

The motor 58 is fixed to the bottom portion 25 of the casing 23 through a motor bracket 61. The motor bracket 61 is fixed to the bottom portion 25 by a non-illustrated bolt. The motor bracket 61 has a size which falls within a width of the motor 58 in the thicknesswise direction of the guide box 12.

The motor 58 is disposed below a lower end of the door 14. Further, a part of the motor 58 is located within the thickness range of the frame assembly 40*a*. More specifically, the motor 58 has a cylinder-shaped barrel portion 58*a*, and a part of the barrel portion 58*a* falls within the thickness range of the frame assembly 40*a*. The motor 58 has a gear portion 58*b* joined to the barrel portion 58*a*. The gear portion 58*b* has a width less than that of the barrel portion 58*a*, and an output shaft is provided in the gear portion 58*b*. The gear portion 58*b* is not located within the thickness range of the frame assembly 40*a*. Thus, the driving pulley 59 fixed to the output shaft provided to protrude from the gear portion 58*b* falls approximately within the thickness range of the frame assembly 40. The output shaft of the motor 58 is provided to protrude toward the platform inner side with respect to the motor 58, in a posture where it is rotatable about a horizontal axis. As above, a part of the motor 58 is disposed to fall within the thickness range of the frame assembly 40*a*, so that it becomes possible to reduce the thickness of the guide box 12 accordingly.

The driving pulley 59*a* is fixed to the output shaft of the motor 58, and adapted to be rotated according to driving of the motor 58. The driving pulley 59*a* has teeth.

The pair of idler pulleys 59*b*, 59*b* are arranged at positions above the driving pulley 59*a*, and separately on respective ones of opposite sides of a center position of the driving pulley 59*a* in the movement direction of the door 14. The idler pulleys 59*b* are disposed in spaced-apart relation to each other in the movement direction of the door 14. Each of the idler pulleys 59*b* is provided in a rotatable manner. A rotation axis of each of the idler pulleys 59*b* is arranged parallel to the output shaft of the motor 58.

The belt member 60 is adapted to be driven according to rotation of the driving pulley 59*a* so as to move the door 14. The belt member 60 includes a toothed belt 60*a*, and a fastener 60*b* fixed to each of opposite ends of the toothed belt 60*a*.

The toothed belt 60*a* is wound over the pair of idler pulleys 59*b*, 59*b*, and meshed with the teeth of the driving pulley 59*a* at a position between the idler pulleys 59*b*, 59*b*. Specifically, the idler pulleys 59*b* press regions of the toothed belt 60*a* on both sides of a portion of the toothed belt 60*a* meshed with the driving pulley 59*a*. This makes it possible to ensure a length of a meshable region of the toothed belt 60*a* with the driving pulley 59*a*. Under a condition that teeth of the toothed belt 60*a* are meshed with the teeth of the driving pulley 59*a*, the opposite ends of the belt member 60 are fixed to the base segment 42 of the door 14.

The fastener 60*b* fixed to one (trailing-side) end of the toothed belt 60*a* is fastened to the first belt joining portion 50*b* provided on the trailing-side end of the lower end 50*a* of the extension portion 50 of the base segment 42. The fastener 60*b* fixed to the other (leading-side) end of the toothed belt 60*a* is fastened to the second belt joining portion 50*c* provided on the leading-side end of the lower end 50*a* of the extension portion 50 of the base segment 42 through an adjustment mechanism 62 capable of adjusting tension of the toothed belt 60*a*. Based on this structure, the toothed belt 60*a* is tightened with a given tension, between the first belt joining portion 50*b* and the second belt joining portion 50*c*. Thus, when the driving pulley 59*a* is rotated according to driving of the motor 58, the belt member 60 is moved according to the rotation of the driving pulley 59*a*, so that the door 14 is pulled by the belt member 60 and thereby moved forwardly or backwardly.

The guiding mechanism 56 includes a linear rail 64 and a guide block 65. The linear rail 64 is attached to a widthwise intermediate region of the lower section 49*b* of the mounting portion 49 so as to extend in the movement direction of the door 14. The linear rail 64 has a length extending over approximately the entire width of the door 14 in the opening/closing direction of the door 14. The linear rail 64 is fixed to the mounting portion 49 while being oriented downwardly. The linear rail 64 extends outside the guide box 12, together with the door 14.

The guide block 65 has a guide groove 65*a* formed in an upper surface thereof. The linear rail 64 is fitted in the guide groove 65*a*. Thus, the linear rail 64 is adapted to be slidingly moved with respect to the guide block 65. A structure in which the linear rail 64 and the guide block 65 are slidingly movable with respect to each other includes two structure: a first structure in which the linear rail 64 and the guide block 65 are slidingly movable with respect to each other while being in surface contact with each other; and a second structure in which the linear rail 64 and the guide block 65 are slidingly movable with respect to each other through a rolling element, such as a bearing ball.

The two guide blocks 65 are provided within the guide box 12. The two guide blocks 65 are arranged while leaving a given distance therebetween in the door opening/closing direction. Each of the guide blocks 65 is supported by a support body 68 fixed to the inside of the guide box 12. The support body 68 has a pair of legs 68*a*, 68*a* fixed to the bottom portion 25 of the casing 23, a standing plate 68*b* disposed between the legs 68*a*, 68*a*, and a loading portion 68*c* fixed to respective upper ends of the legs 68*a*, 68*a*. The loading portion 68*c* is provided to extend over a range between the legs 68*a*, 68*a* and ranges located outside the legs 68*a*, 68*a*, in the door opening/closing direction. The two guide blocks 65 are fixed onto the loading portion 68*c*. In this state, the guide blocks 65 support the linear rail 64 from therebelow.

The pair of legs 68*a*, 68*a* are disposed separately on both sides of the motor 58 in the door opening/closing direction (see FIG. 3). Each of the legs 68*a*, 68*a* has a lower end bent in a horizontal direction, and the lower end is fixed to the bottom portion 25 by a non-illustrated bolt.

Each of the legs 68*a* has a reinforcement portion 68*d* at an intermediate height position thereof. The reinforcement portion 68*d* is provided at approximately the same height position as that of an upper end of the motor 58. As illustrated in FIG. 7, a concave portion 68*e* is formed in a region of each of the legs 68*a* above the reinforcement portion 68*d* to avoid interference with the lower end 50*a* of the extension portion 50 and the belt member 60.

The standing plate 68*b* is provided above the reinforcement portion 68*d*. The standing plate 68*b* is formed in a flat plate shape extending in a direction perpendicular to the output shaft of the motor 58. A pulley bracket 69 is fixed to the standing plate 68*b*, and the two idler pulleys 59*b*, 59*b* are rotatably attached to the pulley bracket 69 (see FIG. 3).

The extension portion 50 of the base segment 42 is disposed on a side opposite to the track, i.e., on the platform inner side with respect to the linear rail 64 and the guide blocks 65. The extension portion 50 extends below the linear rail 64, the guide blocks 65 and the loading portion 68*c*. As illustrated in FIGS. 2 and 3, the extension portion 50 is formed with cutouts 50*d*. The two cutouts 50*d* are provided at respective positions between the first belt joining portion 50*b* and the second belt joining portion 50*c* to each of which a respective one of the opposite ends of the belt member 60 is fixed, in spaced-apart relation to each other in the door opening/closing direction. Based on forming the cutouts 50*d* in the extension portion 50, a part of each of the guide blocks 65 and a part of the linear rail 64 are exposed through the cutouts 50*d*, when viewed from the platform inner side. Thus, through the cutouts 50*d*, inspection of the linear rail 64, for example, an inspection as to whether the linear rail 64 is damaged, can be easily performed. Further, an oil hole 65*b* is provided in a region of the guide block 65 exposed through each of the cutouts 50*d*. The oil hole 65*b* is intended to feed lubrication oil to a sliding contact portion of each of the guide blocks 65 with respect to the linear rail 64. The oil hole 65*b* is used during maintenance. With the oil hole 65*b* being exposed through the each of the cutouts 50*d*, complexity in an operation of feeding oil to the oil hole 65*b* can be reduced.

A cover panel 71 to cover the cutouts 50*d* is detachably attached to the base segment 42 of the door 42. The cover panel 71 is included in a concept of "cover" of the present invention. Based on covering the cutouts 50*d* by the cover panel 71, the guide blocks 65, the linear rail 64 and the belt member 60 located therebelow, exposed through the cutouts 50*d*, are hidden behind the cover panel 71 (see FIG. 7). The cover panel 71 is attached to each of a platform inner-side surface and a track-side surface of the base segment 42.

Figure 6:
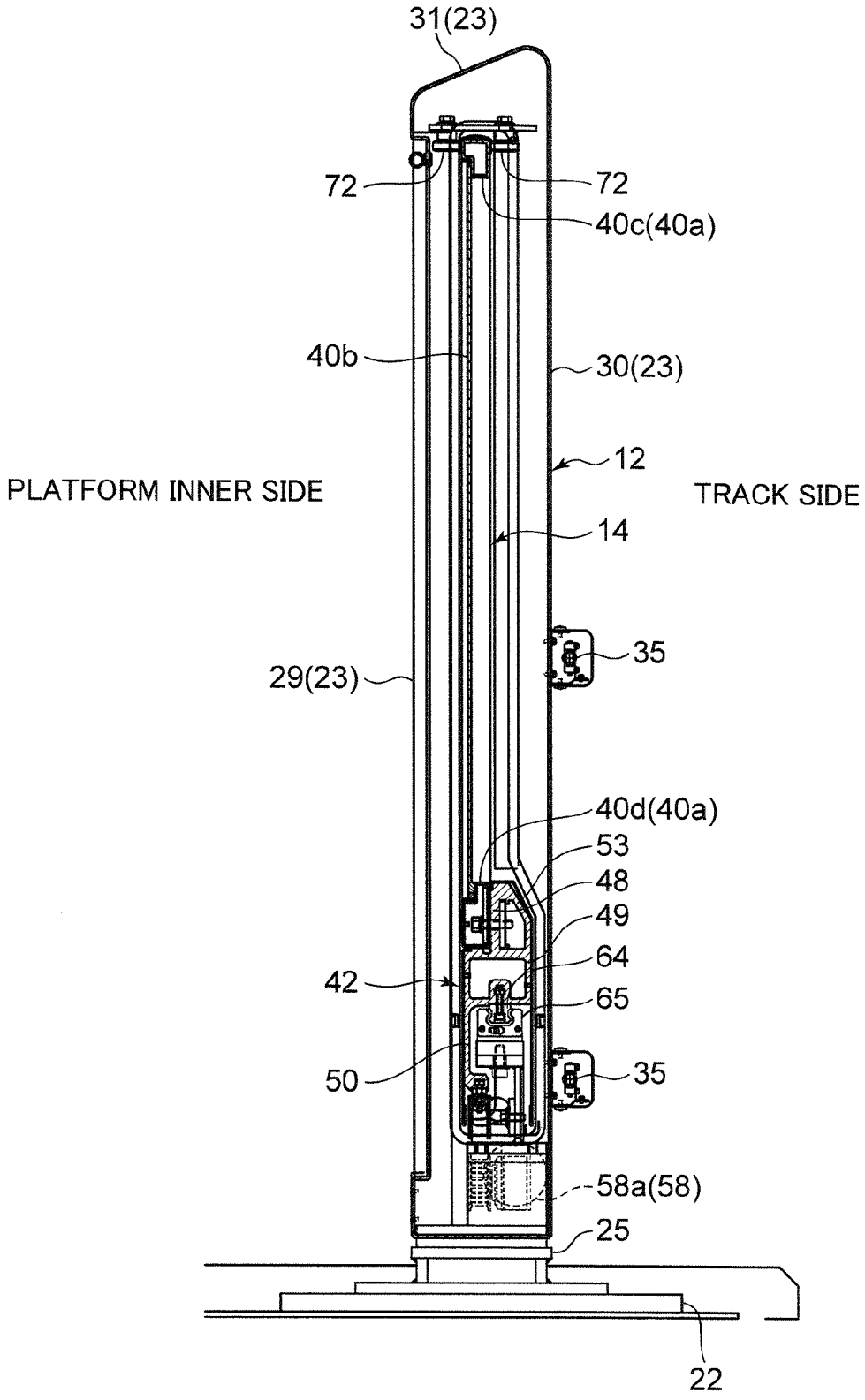
FIG. 6 is a sectional view of the right guide box and door in FIG. 1, when viewed from a trailing side of the door.

As illustrated in FIG. 6, a guide roller 72 is provided in an upper region of the inside of the guide box 12. An upper end of the door 14 is guided by the guide roller 72.

As described above, in the platform door device 10 according to the present embodiment, the door 14 includes the base segment 42 which is detachably joined to the panel-shaped main body 40 and to which the belt member 60 of the driving mechanism 55 is attached. Thus, in the event of damage to the panel-shaped main body 40, for example, in the event that the glass plate 40*b* of the main body 40 is broken, the main body 40 can be replaced by detaching the main body 40 from the base segment 42 while allowing the belt member 60 to be kept attached to the base segment 42, and attaching a new main body 40 to the base segment 42. This makes it possible to replace the main body 40 without exerting any influence on the driving mechanism 55, which eliminates a need for adjustment of the driving mechanism 55 during the replacement operation for the main body 40. Therefore, in the event of damage to the main body 40 of the door 14, a time required for the replacement operation can be reduced.

Meanwhile, in a structure where the belt member 60 is directly joined to the main body of the door 14 and tightened with a given tension, when the main body is detached from the belt member 60 during replacement of the main body, the tension of the belt member 60 is loosened. Thus, it is necessary to re-adjust the tension of the belt member 60. However, in the structure according to the present embodiment, the belt member 60 is attached to the base segment 42 of the door 14, and the main body 40 of the door 14 is detachably joined to the base segment 42, so that it becomes possible to allow the belt member 60 to be kept joined to the base segment 42 while being tightened with a given tension, during replacement of the main body 40. Thus, it is not necessary to perform adjustment of the tension of the belt member 60, i.e., a complicate operation in connection with the replacement of the main body 40.

In the present embodiment, the base segment 42 of the door 14 is attached to the linear rail 64 of the guiding mechanism 56. Thus, in the event of damage to the main body 40 of the door 14, the main body 40 can be replaced by detaching the main body 40 from the base segment 42 while allowing the linear rail 64 to be kept attached to the base segment 42, and attaching a new main body 40 to the base segment 42. In other words, during replacement of the main body 40, it is only necessary to detach the main body 40 from the base segment 42 and attach a new main body 40 to the base segment 42, so that it becomes possible to omit an operation of attaching and detaching the door 14 with respect to each of the belt member 60 of the driving mechanism 55 and the linear rail 64 of the guiding mechanism 56. This makes it possible to simplify the replacement operation for the main body 40 of the door 14.

In the present embodiment, the cutouts 50*d* to expose a part of the linear rail 64 and each of the guide blocks 65 are provided in the extension portion 50 of the base segment 42 located on the side opposite to the track with respect to the linear rail 64 and the guide blocks 65. Thus, even if the extension portion 50 covers the linear rail 64 and the guide blocks 65, at a position opposite to the track with respect to the linear rail 64 and the guide blocks 65, maintenance of the linear rail 64 and the guide blocks 65 can be performed on the platform P through the cutouts 50*d*. This makes it possible to easily perform the maintenance of the guiding mechanism 56.

In the present embodiment, the cover panel 71 to cover the cutouts 50*d* is detachably attached to the base segment 42. Thus, during a normal actuation of the platform door device 10, the cutouts 50*d* can be covered by the cover panel 71 so as to prevent foreign substances such as dust from entering through the cutouts 50*d*. Further, during maintenance, the cover panel 71 can be detached so as to easily perform the maintenance of the linear rail 64 and the guide blocks 65 through the cutouts 50*d*.

It is understood that the present invention is not limited to the present embodiment, but various changes and modifications may be made therein without departing from the spirits and scope of the present invention.

For example, although the present embodiment has been described based on a structure in which the door 14 penetrates through the guide box 12 as one example of a guide body, and the trailing end of the door 14 in the opened position protrudes from the guide box 12, the present invention is not limited to this structure. For example, the door 14 may be housed in a door case body as another example of the guide body, when it is in the opened position.

Although the present embodiment has been described based on a so-called belt drive system in which the driving mechanism 55 includes the driving pulley 59*a* and the belt member 60, and the door 14 is openably/closably driven by the belt member 60, the present invention is not limited thereto. For example, the driving mechanism may be a driving mechanism based on a rack-and-pinion drive system. In this case, a rack (illustration is omitted) may be fixed to a lower surface of the extension portion 50 located at the lower end of the door 14, and a pinion as a rotation body attached to the output shaft of the motor 58 may be meshed with the rack. In the driving mechanism based on the rack-and-pinion drive system, as long as the frame assembly 40*a* of the main body 40 is adapted to be detachable from the base segment 42, a burden of the replacement operation for the main body 40 can be reduced, and a time required for the replacement operation can be reduced.

In the present embodiment, the linear rail 64 is attached to the mounting portion 49 of the base segment 42, and each of the guide blocks 65 is fixed to the support body 68 within the guide box 12. Alternatively, each of the guide blocks 65 may be attached to the mounting portion 49 of the base segment 42, and the linear rail 64 may be fixed to the support body 68 within the guide box 12. In this case, the guide body may be formed as a door case body adapted to house the door 14 in the opened position.

The above embodiment can be summarized as follows.

The platform door device according to the above embodiment comprises a door, and a driving mechanism for moving the door forwardly and backwardly to close and open a gate on a platform, wherein: the driving mechanism includes a motor, a rotation body adapted to be rotated by the motor, and a driven body adapted to be driven according to the rotation of the rotation body so as to move the door; and the door includes a panel-shaped main body, and a base segment which is detachably joined to the main body and to which the driven body is attached.

In this platform door device, the door includes the base segment which is detachably joined to the panel-shaped main body and to which the driven body of the driving mechanism is attached. Thus, in the event of damage to the panel-shaped main body, the main body can be replaced by detaching the main body from the base segment and attaching a new main body to the base segment while allowing the driven body to be kept attached to the base segment. This makes it possible to replace the panel-shaped main body of the door without exerting any influence on the driving mechanism, which eliminates a need for adjustment of the driving mechanism during the replacement operation for the main body. Therefore, in the platform door device, in the event of damage to the panel-shaped main body of the door, a time required for the replacement operation can be reduced.

In the above platform door device, the driving mechanism may include a pair of pulleys separately arranged on respective ones of opposite sides of the rotation body, wherein the rotation body may have teeth; the driven body may consist of a belt member which is wound over the pair of pulleys and meshed with the teeth of the rotation body at a position between the pulleys; and the base segment may be provided with a first belt joining portion joined to one end of the belt member, and a second belt joining portion joined to the other end of the belt member while allowing the belt member to be tightened with a given tension.

In this structure, the rotation body is rotated and the belt member is moved, according to driving of the motor, so that the door can be pulled by the belt member and thereby moved forwardly or backwardly. This makes it possible to form a specific structure of the driving mechanism for moving the door forwardly and backwardly. In a structure where a belt member is used as the driven body to move the door, if the belt member is directly joined to the main body of the door and tightened with a given tension, the tension of the belt member is loosened during replacement of the main body. Thus, it is necessary to re-adjust the tension of the belt member. However, in the structure according to the above embodiment, it becomes possible to allow the belt member to be kept joined to the base segment while being tightened with a given tension, during replacement of the main body of the door. Thus, it is not necessary to perform the complicate adjustment.

Preferably, the above platform door device comprises a guide body installed on the platform, and a guiding mechanism for guiding the door which is being moved forwardly or backwardly, wherein the guiding mechanism includes a linear rail extending in a direction of the movement of the door, and a guide block adapted to be slidingly moved with respect to the linear rail, and wherein one of the linear rail and the guide block is attached to the base segment, and a remaining one of the linear rail and the guide block is fixed to the guide body.

In this structure, the base segment of the door is attached to the linear rail or the guide block of the guiding mechanism. Thus, in the event of damage to the panel-shaped main body of the door, the main body can be replaced by detaching the main body from the base segment and attaching a new main body to the base segment while allowing the linear rail or the guide block to be kept attached to the base segment. In other words, in this structure, during replacement of the main body of the door, it is only necessary to detach the main body from the base segment and attach a new main body to the base segment, so that it becomes possible to omit an operation of attaching and detaching the door with respect to each of the driven member of the driving mechanism and the linear rail or the guide block of the guiding mechanism. This makes it possible to simplify the replacement operation for the main body of the door.

In this case, it is preferable that the base segment has a portion which is located on a side opposite to a track with respect to the linear rail and the guide block, and formed with a cutout for exposing at least a part of the linear rail and the guide block.

In this structure, even if a portion of the base segment covers the linear rail and the guide block, at a position opposite to the track with respect to the linear rail and the guide block, maintenance of the linear rail and the guide block can be performed on the platform through the cutout. This makes it possible to easily perform the maintenance of the guiding mechanism.

Further, in this case, it is preferable that the platform door device comprises a cover for covering the cutout, that is detachably attached to the base segment.

In this structure, during a normal actuation of the platform door device, the cutout can be covered by the cover so as to prevent foreign substances such as dust from entering through the cutout. Further, during maintenance, the cover can be detached so as to easily perform the maintenance of the linear rail and the guide block through the cutout.

As mentioned above, the platform door device according to the above embodiment makes it possible to reduce a time required for a replacement operation in the event of damage to the panel-shaped main body of the door.

The invention claimed is:

1. A platform door device comprising a guide body installed on a platform, a door, a driving mechanism for moving the door forwardly and backwardly to close and open a gate on the platform, and a guiding mechanism for guiding the door being moved forwardly or backwardly, wherein:

the driving mechanism includes a motor, a rotation body adapted to be rotated by the motor, and a driven body adapted to be driven according to the rotation of the rotation body so as to move the door; and the door moves forwardly or backwardly with at least a part of the door being located inside the guide body, and includes a panel-shaped main body, and a base segment, the base segment being detachably joined to the main body and to which the driven body is attached;

the guiding mechanism includes a linear rail extending in a direction of the movement of the door, and a guide block adapted to be slidingly moved with respect to the linear rail;

the main body includes a frame assembly that is formed in a frame shape by assembling a plurality of frame members together;

the base segment is joined to the frame assembly so that at least a part of the guide block is located within a thickness range of the frame assembly and includes a mounting portion and an extension portion, the mounting portion having a lower section, the extension portion extending downward from the lower section of the mounting portion and having a thickness less than a thickness of the frame assembly;

the lower section of the mounting portion having a portion that is located within the thickness range of the frame assembly and is mounted with one of the linear rail and the guide block; and the driven body being located within the thickness range of the frame assembly at a position lower than one of the linear rail and the guide block and being joined to a lower end portion of the extension portion.

2. The platform door device according to claim 1, wherein the driving mechanism includes a pair of pulleys separately arranged on respective ones of opposite sides of the rotation body, and wherein:

the rotation body has teeth;

the driven body consists of a belt member which is wound over the pair of pulleys and meshed with the teeth of the rotation body at a position between the pulleys; and the lower end portion of the extension portion is provided with a first belt joining portion joined to one end of the belt member, and a second belt joining portion joined to the other end of the belt member while allowing the belt member to be tightened with a given tension.

3. The platform door device according to claim 2, wherein a remaining one of the linear rail and the guide block is fixed to the guide body.

4. The platform door device according to claim 3, wherein the extension portion is located on a side opposite to a track with respect to the linear rail and the guide block, and formed with a cutout for exposing at least a part of the linear rail and the guide block.

5. The platform door device according to claim 4, which comprises a cover, for covering the cutout, that is detachably attached to the base segment.

6. The platform door device according to claim 1, wherein a remaining one of the linear rail and the guide block is fixed to the guide body.

7. The platform door device according to claim 6, wherein the extension portion is located on a side opposite to a track with respect to the linear rail and the guide block, and formed with a cutout for exposing at least a part of the linear rail and the guide block.

8. The platform door device according to claim 7, which comprises a cover, for covering the cutout, that is detachably attached to the base segment.

* * * * *

UNITED STATES PATENT AND TRADEMARK OFFICE

CERTIFICATE OF CORRECTION

PATENT NO. : 8,464,470 B2
APPLICATION NO. : 13/201493
DATED : June 18, 2013
INVENTOR(S) : Satoshi Katagata et al.

It is certified that error appears in the above-identified patent and that said Letters Patent is hereby corrected as shown below:

Title page: Item 73 should read

Assignees: Nabtesco Corporation
East Japan Railway Company

Signed and Sealed this
Fifteenth Day of April, 2014

Michelle K. Lee

Michelle K. Lee
*Deputy Director of the United States Patent and Trademark Office*